US008292268B2

(12) United States Patent
Kempf

(10) Patent No.: US 8,292,268 B2
(45) Date of Patent: Oct. 23, 2012

(54) REDUCED SIZE AND RECONFIGURABLE WINCH

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 12/912,510

(22) Filed: Oct. 26, 2010

(65) Prior Publication Data

US 2011/0101292 A1 May 5, 2011

Related U.S. Application Data

(60) Provisional application No. 61/256,504, filed on Oct. 30, 2009.

(51) Int. Cl.
*B66D 1/26* (2006.01)

(52) U.S. Cl. ..... 254/278; 254/342

(58) Field of Classification Search ..... 254/278, 254/286, 338, 342, 371, 385
See application file for complete search history.

(56) References Cited

U.S. PATENT DOCUMENTS

| | | | | | |
|---|---|---|---|---|---|
| 3,539,123 | A * | 11/1970 | Shutt | 242/386 |
| 3,602,482 | A * | 8/1971 | Guinot | 254/361 |
| 3,787,031 | A * | 1/1974 | Lucas | 254/290 |
| 3,788,605 | A * | 1/1974 | Johnson | 254/361 |
| 3,885,656 | A * | 5/1975 | Michling et al. | 192/225 |
| 4,661,660 | A * | 4/1987 | von Sothen et al. | 191/12.2 A |
| 4,854,547 | A * | 8/1989 | Oliphant | 254/271 |
| 4,974,814 | A * | 12/1990 | Cundy | 254/345 |
| 5,398,923 | A * | 3/1995 | Perry et al. | 254/375 |
| RE36,216 | E * | 6/1999 | Telford | 254/375 |
| 6,113,023 | A * | 9/2000 | Ueffing et al. | 242/388.6 |
| 6,283,453 | B1 * | 9/2001 | Berget | 254/278 |
| 6,520,485 | B1 * | 2/2003 | Soot | 254/331 |
| 7,234,685 | B2 * | 6/2007 | Britten | 254/385 |
| 7,658,370 | B2 * | 2/2010 | Rotzler et al. | 254/344 |
| 7,862,009 | B2 * | 1/2011 | Folk et al. | 254/278 |

* cited by examiner

*Primary Examiner* — Emmanuel M Marcelo
(74) *Attorney, Agent, or Firm* — Law Office of Scott C. Harris, Inc.

(57) ABSTRACT

A zero fleet winch that has a hollow drum and a motor and gear assembly mounted inside the drum. A roller assembly moves with the rotation to keep constant the angle where the cable goes on and off the drum.

14 Claims, 7 Drawing Sheets

REDUCED SIZE AND RECONFIGURABLE WINCH

This application claims priority from provisional application No. 61/256,504, filed Oct. 30, 2009, the entire contents of which are herewith incorporated by reference.

BACKGROUND

Winches can be used to move various objects and scenery, especially in a stage environment.

In some applications, it becomes important that the cable which goes on and off of the cable holding drum on the winch is always at a precisely same (usually orthogonal) angle relative to the drum.

Winches which keep this constant angle of the cable to the winch are called zero fleet winches.

When used in stage applications, the size of the winch can be extremely important, since the winch often needs to be mounted within special trussing. Having a winch which has many different kinds of possible mounting and rigging scenarios is also useful, since it can allow flexibility in the way that the winch is hooked up to different loads.

SUMMARY

An embodiment describes a zero fleet winch with a reduced size. According to another embodiment, the winch is reconfigurable between different numbers of operating configurations.

According to an embodiment, a rotating hollow drum is formed, and at least part of the motor and gearbox are located within the hollow drum. This can reduce the overall size of the device.

DETAILED DESCRIPTION

The present application describes a unique winch of shortened size which can be used in various locations and configurations. According to an embodiment, this winch is called a "roadie" winch.

The Roadie winch of an embodiment is a "zero fleet" winch designed specifically for the concert touring market. It has a uniquely mounted gearbox and motor inside the drum which allows the winch to fit in smaller areas, e.g., one third smaller than other similar winches. For example, an embodiment of an assembled winch can fit inside a 5' stick of a 20.5" box or Tomcat truss.

The winch is designed for use primarily in the concert touring and special events markets, but could also be utilized in other live entertainment applications.

The winch has six rigging configurations: driving 600 lbs on a single operating loop, driving 1200 lbs on a dual operating loop, dead hauling 600 lbs on one pick, dead hauling 1200 lbs on two picks, dead hauling 1200 lbs on three picks, or dead hauling 1200 lbs on four picks. By mounting the motor and gearbox inside the drum, the winch is also made shorter, for example ⅓ shorter than the equivalent British traveling drum winch.

Figure 1:
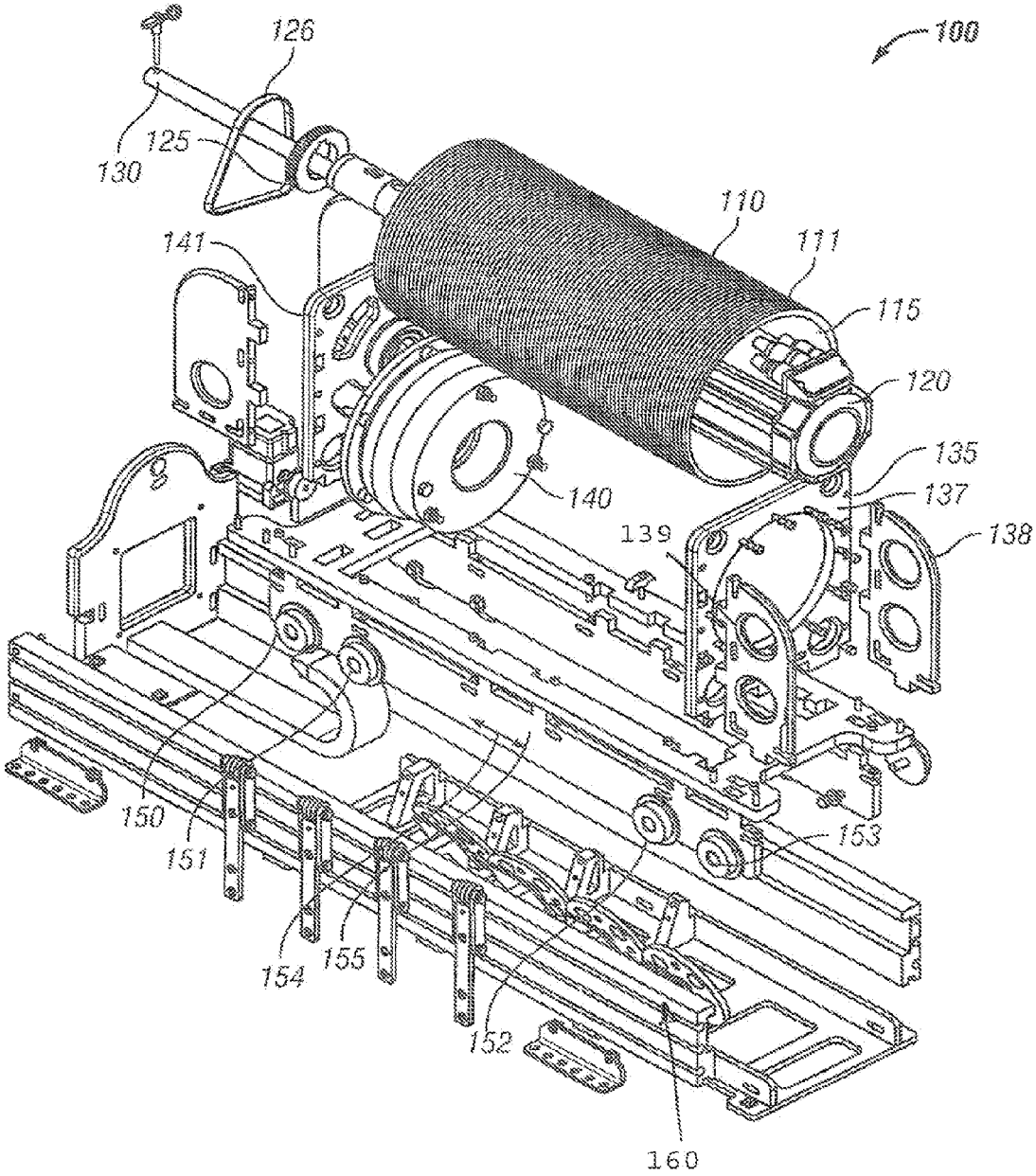
FIG. 1 shows an exploded view showing the parts according to an embodiment.

An embodiment shown in FIG. 1 shows an exploded view of the winch assembly 100 showing its component parts. One important part of the winch is the roller 110 which includes an outer surface with a number of grooves such as 111 thereon. The grooves are sized to hold the wire or cable that is wound and unwound from the winch. The roller 110 is made of aluminum and is substantially hollow on the inside, forming a hollow inside surface. The inside surface 115 forms a housing which houses the winch rotating motor 120. The motor 120 is activated to rotate the drum to extend and retract the cable. The rotating motor also includes, as appropriate, a gearbox to change the speed of rotation of the drum.

A timing pulley 125 may be mounted on the shaft 130 of the motor. Timing pulley 125 may be connected to a timing belt 126 which may connect to other structures that are associated with the winch operation, and to determine the location of winding or unwinding of the cable. The timing belt can set the movement of the zero fleet assembly to synchronize with the position at which the cable is when it goes on and off of the drum.

The roller 110 also has a brake 140 that forms the other side which holds the rotating roller. The brake 140 can be, for example, electronically controlled.

The frame 135 includes a a first surface 137 that is substantially perpendicular to the outer surface of the roller. The surface 137 includes mounting parts 138 and 139 that are perpendicular to the surface 137, to thereby form a box-shaped structure that provides significant structure to hold the surface in place. The opposite side support 141 includes the same or analogous structure. The box-shaped structures can provide significant structural integrity.

The housing also includes a number of sheaves which move in a synchronized way relative to the location of the cable pay-on or pay-off of the drum. Other sheaves can be provided to change the direction that the cable is output from the winch.

For example, there may be four traveling sheaves 150, 151, 152, 153. For example, the rollers may be mounted on a slidable assembly such as 155 which may move back and forth in the direction of arrows 154. An acme screw controls the movement of the assembly 155 to synchronize with the location where the cable pays on or off of the drum. The acme screw is driven by timing belt 126. The acme screw has the same screw pitch as the pitch of the grooves on the drum, so that the movement of the sheaves is synchronous with the amount by which the cable moves laterally along the drum as it goes on and off the drum.

A direction reversing roller assembly 160 may change the direction in which the cable pays on and off of the overall assembly.

Figure 2:
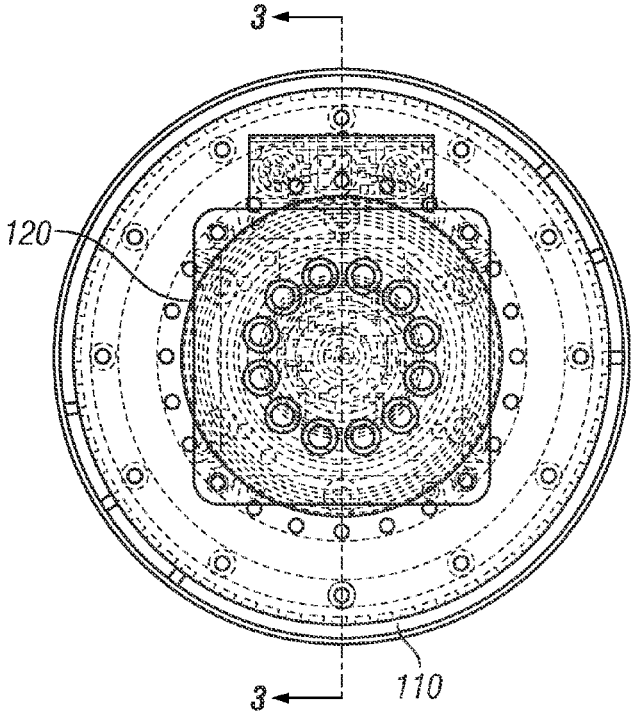
FIG. 2 shows an end on cross-sectional view.

FIG. 2 shows a cross-section through the drum and motor in their assembled configuration, showing how the motor 120 is mounted inside the drum 130.

Figure 3:
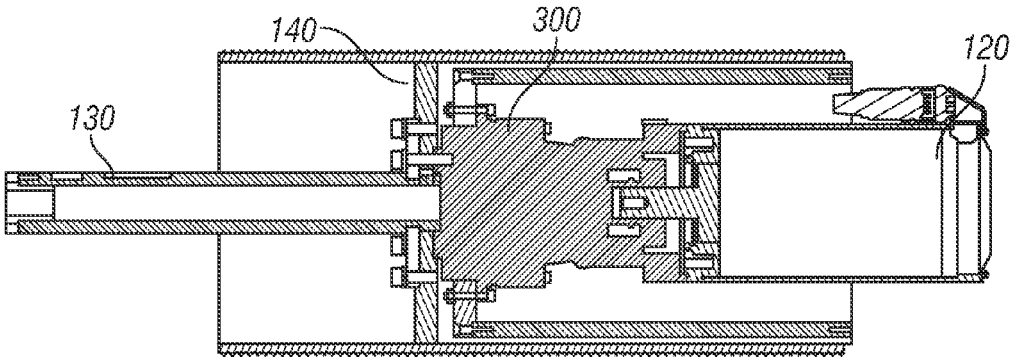
FIG. 3 shows a lateral cross-sectional view.

FIG. 3 shows a cross-section along the line 3-3 in FIG. 2. This shows the motor assembly 120 with its attached gear assembly 300 and shaft 130. At least a portion of the motor and gearbox assembly is inside the hollow drum. The brake 140 is also mounted in the inside of the drum and can attach to the motor and gearbox assembly by screws and bolts. The brake has an annular hole, through which the shaft 130 extends.

Figure 4:
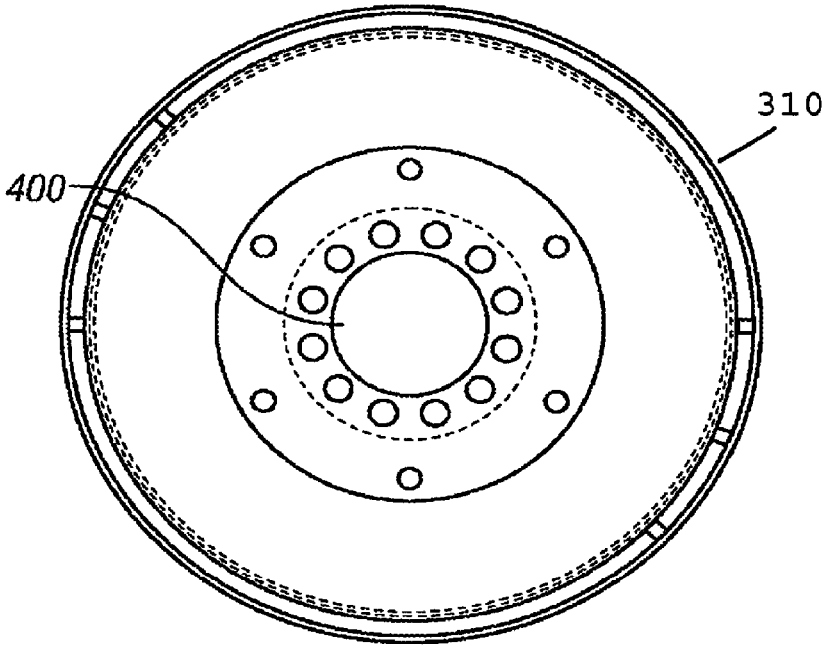
FIG. 4 shows a brake mounting mechanism.
Figure 5:
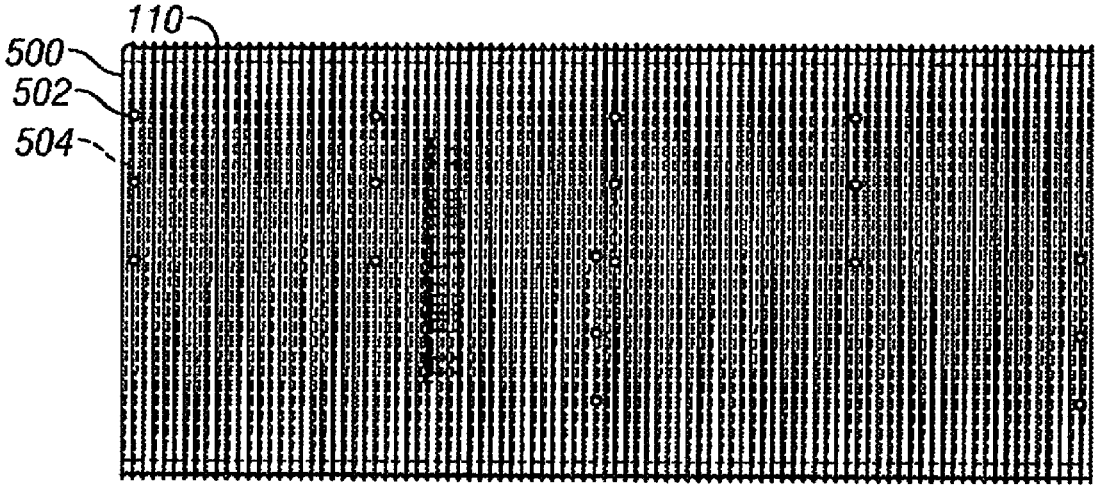
FIG. 5 shows a view of the outer surface of the cylinder.

FIG. 4 illustrates the mounting plate 310 with its screw holes, and the open central portion 400. FIG. 5 shows the surface of the drum 110, showing the grooves thereon, and also showing the pattern of holes such as 500, 502, 504. The holes can be tapped in order to allow attaching surface clamps to terminate the cable without access to the interior of the drum.

The gearbox may be a planetary in-line gearbox with a 55 to 1 reduction ratio.

Figure 6:
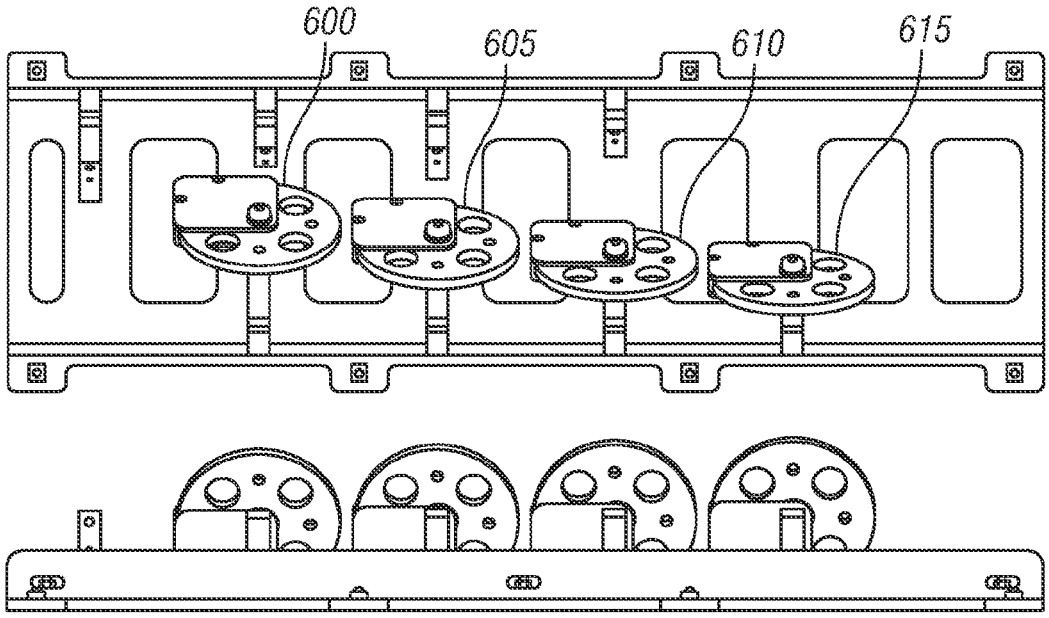
FIGS. 6, 7 and 10 show a sheave configuration for a dead haul operation.
Figure 7:
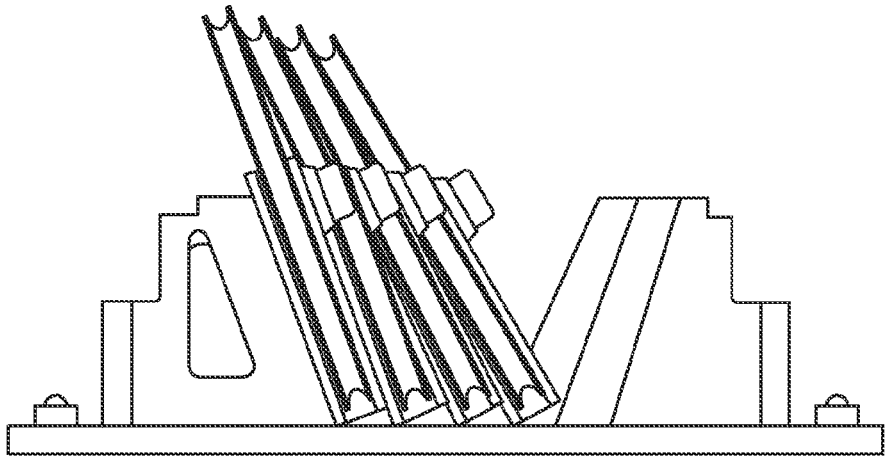

FIG. 6 illustrates the whole sheave assembly showing the different shieve 600, 605, 610, 615. Each sheave is at a different location. FIG. 7 illustrates how the sheaves are at a different angle. The sheaves are at different angles so the top point at the tangent side of the drum and the bottoms feed the cables out of the end of the winch in a neat row, offset to clear the other sheaves. If the sheaves were all the same angle, each cable could run into the sheave in front of it.

FIGS. 6 and 7 and show a sieve assembly intended for dead haul operation, e.g., in this embodiment, a four point dead haul.

Figure 8:
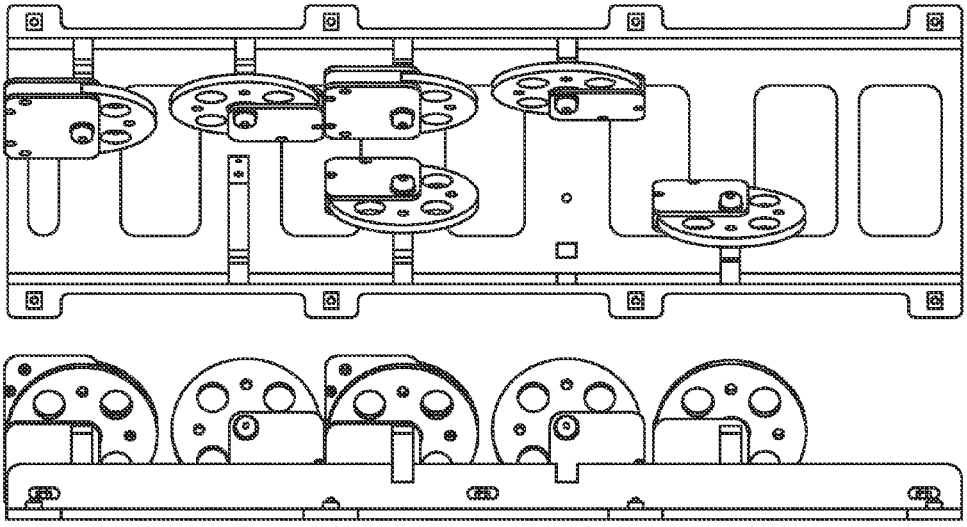
FIGS. 8, 9 and 11 show a sheave and operational configuration for a dual operating loop configuration.
Figure 9:
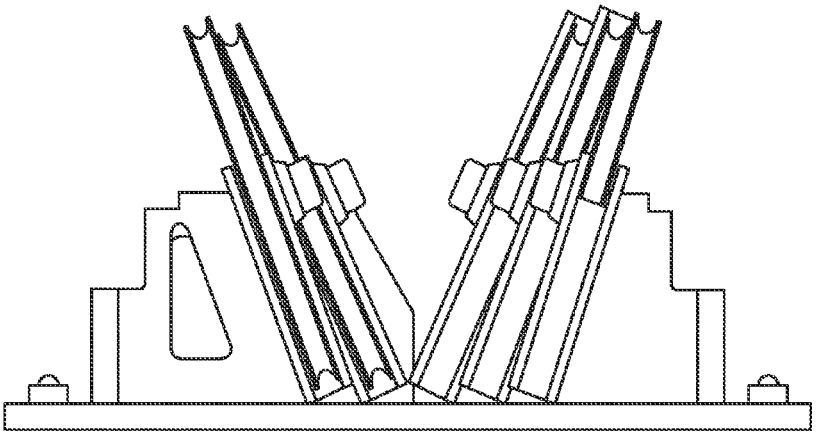
Figure 10:
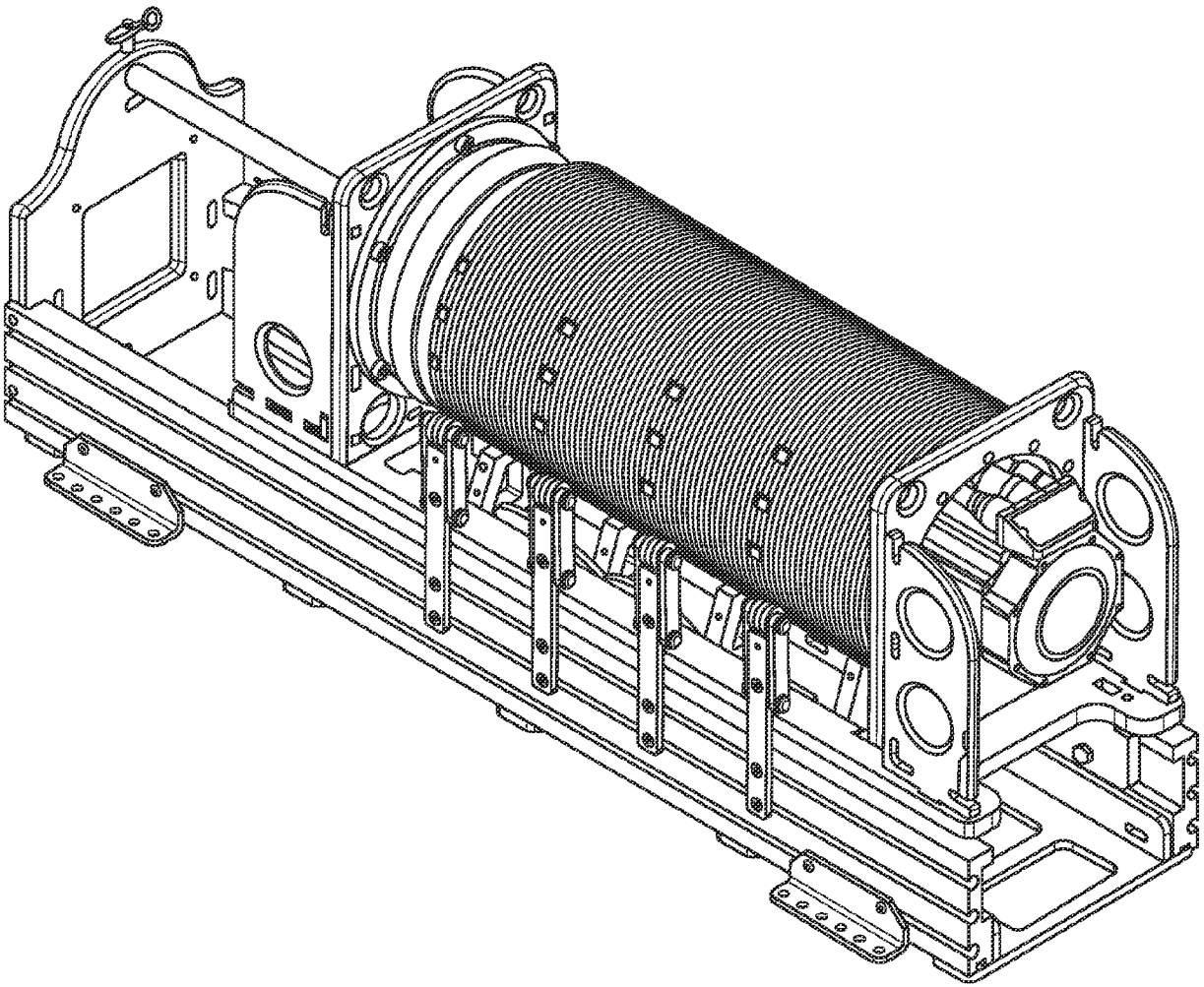
Figure 11:
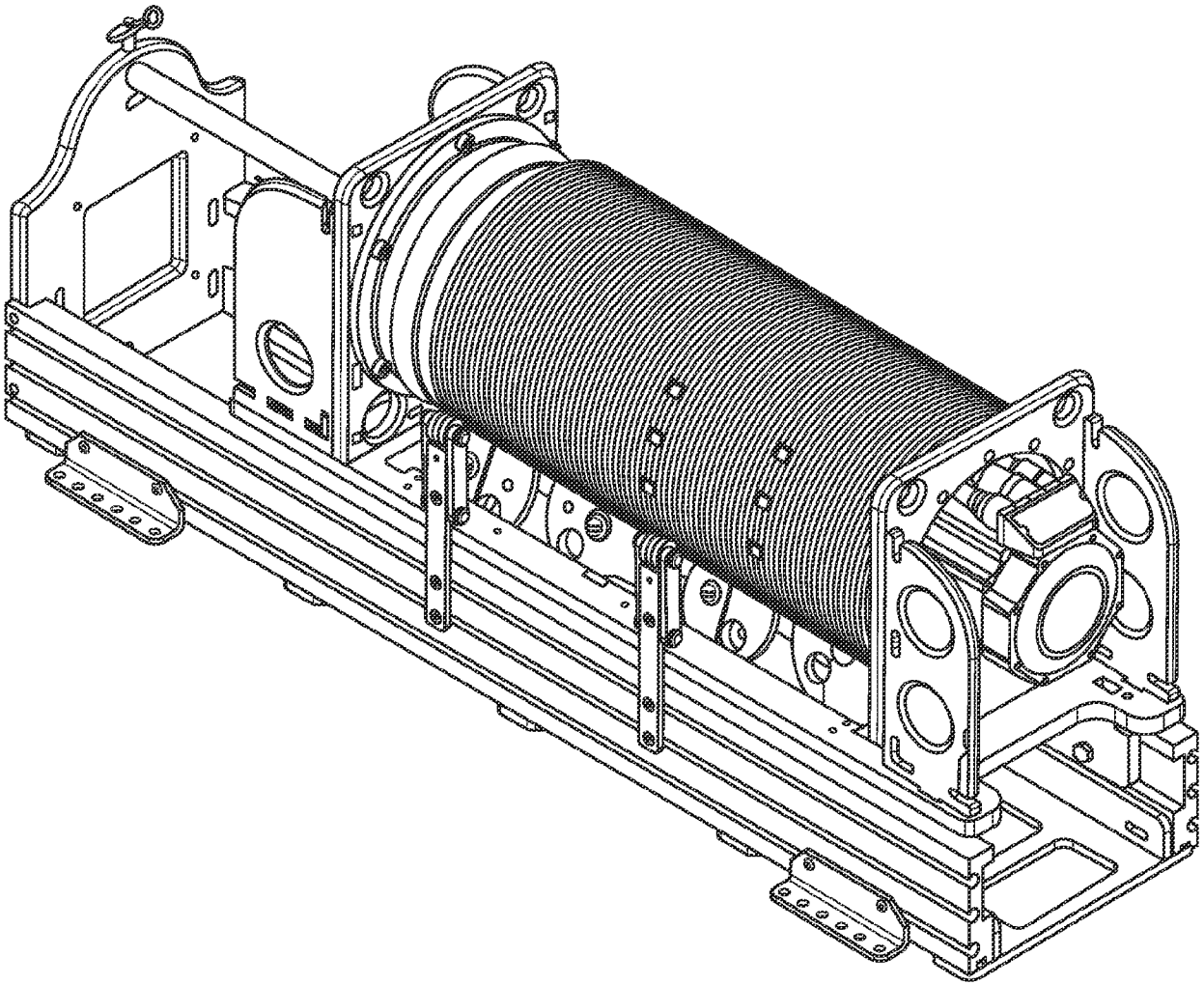

A different sheave assembly shown in FIGS. 8 and 9 and 11 is intended to be used for dual operating loop operation.

An embodiment, as described herein has the following dimensional goals:

Length: 49.2"

Width: 12"

Height: 19"

Weight: 325 lbs the embodiment has the following operating parameter targets—

Max load speed: 3 fps with 55:1 gearbox (winch could accept 27.5:1 gearbox for 600 lbs at 6 fps)

Max load line-pull: 1200 lbs (on dual ¼" cables with 10:1+ safety factor)

Max load travel: 1 or 2 picks at 100', 3 or 4 picks at 43'

Examples of winch applications include

Dead hauling heavy scenic units, electrics, video walls, or performers

Driving heavy duty travelers

Driving heavy duty counterweight assist line sets

Driving heavy duty deck tracks

Winch mounting can be inline with a tomcat plated 20.5" box truss. The mounting can be horizontal above/below/beside surface with custom mounts. The mounting can be vertical above/below/beside surface or truss with custom mounts.

The winch mounts inside a customized 5' stick of 20.5" Tomcat truss

The winch has six movable sheaves for adapting to each of the rigging configurations.

The winch has up to six movable spring loaded cable keepers.

The winch has up to four movable mounting feet.

The winch can use the following parts according to an embodiment:

Motor—Allen Bradley MPL-A540P

Gearbox—Stober PHQ722 55:1 or 27.5:1 depending on configuration

Acme screw—Duff Norton 25 mm×7 mm acme

Acme screw nut—Duff Norton 25 mm×7 mm acme

Acme screw pin—¼" ball detent MMC

Limit box—TER MF2C100:1

Limit box/encoder driver—Martin 60L037 55 mm kwss

Limit box driven—20L037 8 mm bore dss

Absolute encoder—Sick-Stegman ATM 60

Absolute encoder driven—20L037 8 mm bore dss

Feedback belt—?L037

Secondary brake—KEB

Brake shaft bearing—SKF 55 mm

Cable chain—Igus 14.4.48

Linear bearings—Rollon NCS43

Linear guide channels—Rollon 43

Sheave bearings—R8 General

The following parts can be CNC cut and machined:

Cable chain support

Acme end plate

Encoder plate

Limit plate

Brake plate gussets

Brake plate

Motor plate

Motor plate gussets

Gearbox plate

Sled plate

Bearing plates

Target winch speed calculation—

3400 rpm motor speed divided by 55:1 gearbox equals a drum speed of 61.8 rpm multiplied by a 34.4" drum circumference per revolution equals 2126 inches per minute divided by 12" inches per foot and 60 second per minute equals a line speed of roughly 3 feet per second.

Target winch line pull calculation—

A 126 inlbs motor into a 55:1 gearbox produces 6390 inlbs of torque multiplied by 94% gearbox efficiency equals 6514 inlbs at the drum shaft divided by a drum radius of 5.47" yields 1200 lbs of line pull.

Target winch travel calculation with 1 or 2 picks follows. A 10.94" diameter drum 11" long with 0.275" lead for ¼" cable has roughly 40 complete wraps minus 5 safety wraps equals 35 active wraps multiplied by 34.4 inches per wrap equals 1204 inches divided by 12 inches per foot equals 100' max load travel.

Target winch travel calculation with 3 or 4 picks follows. A 10.94" diameter drum 5.5" long with 0.275" lead for ¼" cable has roughly 20 complete wraps minus 5 safety wraps equals 15 active wraps multiplied by 34.4 inches per wrap equals 516 inches divided by 12 inches per foot equals 43' max load travel.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other configurations for other applications are possible.

Also, the inventor intends that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A winch assembly, comprising:

a drum, adapted to hold cable thereon, wherein said drum is substantially hollow, forming a cavity inside the hollow portion of the drum; and a motor assembly, rotating to create rotational force for the drum, said drum being rotated to cause the cable to pay on to the drum and to also pay off of the drum, wherein said motor assembly is only partly mounted inside the drum and where a first side of said motor assembly extends outside of said drum and exposed to an ambient environment, a second opposite side of said motor assembly providing rotational force, said motor assembly also including a gearing assembly connected directly to said motor assembly, and a drive shaft connected to said gearing assembly; and a brake assembly, connected directly to said gearing assembly, inside said drum.

2. An assembly as in claim 1, wherein said gearing assembly is a planetary gear assembly, coupled to said motor, where said planetary gear assembly is mounted inside said drum.

3. An assembly is in claim 1, wherein said winch is a zero fleet winch, and further comprising a roller assembly, positioned to receive a cable that is wound on said drum, a shaft extending from said drum, and a timing belt coupled to said shaft, and at least one acme screw, driven by said timing belt that moves said roller assembly in sync with a rotation of said drum such that said roller assembly follows a position at which said cable winds on or off the drum.

4. An assembly as in claim 3, further comprising a sheave assembly, coupled to receive cable that has passed over said roller assembly, wherein said sheave assembly is replaceable.

5. An assembly as in claim 4, wherein said sheave assembly is configured for a dead haul.

6. An assembly as in claim 4, wherein said sheave assembly is configured for a dual operating winch configuration.

7. An assembly as in claim 4, wherein said sheave assembly includes plural different sheave wheels, each at a different angle.

8. A winch assembly, comprising:

a drum, holding cable on a surface thereof, and rotating to wind cable on and wind cable off said surface, wherein said drum is substantially hollow, forming a cavity inside the hollow portion of the drum; a mounting plate, inside said drum, said mounting plate coupled to surfaces of said drum and forming a mounting surface inside said drum;

a motor and gear assembly, having a motor that is energized to rotate to create rotational force for the drum, at least a portion of said motor and gear assembly being mounted inside the drum, and said motor and gear assembly being connected only to said mounting plate and to said drum; and a brake assembly, connected to said mounting plate, inside said drum.

9. An assembly is in claim 8, wherein said winch is a zero fleet winch, and further comprising a roller assembly, positioned to receive a cable that is wound on said drum, where said roller assembly is driven in sync with a rotation of said drum such that said roller assembly follows a position at which said cable winds on or off the drum.

10. An assembly is in claim 9, wherein said drum has grooves on an outer surface thereof, each groove holding a single strand of said cable.

11. An assembly as in claim 9, further comprising a shaft extending from said drum, and a timing belt coupled to said shaft, and at least one acme screw, driven by said timing belt that moves said roller assembly in sync with said position.

12. An assembly as in claim 9, further comprising a sheave assembly, coupled to receive cable that has passed over said roller assembly, wherein said sheave assembly is replaceable.

13. An assembly as in claim 9, wherein said sheave assembly includes plural different sheave wheels, each at a different angle.

14. An assembly as in claim 9, wherein a first end of said motor is exposed to an ambient environment, a second opposite side of said motor assembly providing rotational force, and said gear assembly connected directly to said motor assembly.

* * * * *